US007240966B2

(12) United States Patent
Stone et al.

(10) Patent No.: US 7,240,966 B2
(45) Date of Patent: Jul. 10, 2007

(54) HEADREST SUPPORT AND ADJUSTMENT MECHANISM

(75) Inventors: Christopher C. Stone, Newberg, OR (US); Brian E. Bonn, Portland, OR (US); William R. Stewart, Tigard, OR (US)

(73) Assignee: A-dec, Inc., Newberg, OR (US)

( * ) Notice: Subject to any disclaimer, the term of this patent is extended or adjusted under 35 U.S.C. 154(b) by 39 days.

(21) Appl. No.: 11/114,876

(22) Filed: Apr. 25, 2005

(65) Prior Publication Data

US 2005/0184573 A1 Aug. 25, 2005

Related U.S. Application Data

(63) Continuation-in-part of application No. 10/236,687, filed on Sep. 5, 2002, now Pat. No. 6,893,096.

(51) Int. Cl.
*A47C 7/36* (2006.01)
*A61G 15/00* (2006.01)

(52) U.S. Cl. ..... 297/409; 297/408

(58) Field of Classification Search ..... 297/391, 297/408, 409, 410, 61, 353, 411.36, 374
See application file for complete search history.

(56) References Cited

U.S. PATENT DOCUMENTS

| | | | | |
|---|---|---|---|---|
| 955,094 | A | 4/1910 | McNeel | |
| 1,576,915 | A * | 3/1926 | Koenigkramer | 297/409 |
| 1,597,847 | A | 8/1926 | Walton | |
| 2,278,080 | A | 3/1942 | Koenigkramer et al. | |
| 2,434,007 | A * | 1/1948 | O'Dea | 297/230.14 |
| 2,666,476 | A * | 1/1954 | Lycan | 297/404 |
| 3,135,549 | A | 6/1964 | Larsson | |
| 3,692,356 | A * | 9/1972 | Mertens | 297/408 |
| 3,817,576 | A | 6/1974 | Ciavattoni et al. | |
| 3,853,350 | A | 12/1974 | Leffler | |
| 4,062,587 | A | 12/1977 | Wolters | |

(Continued)

FOREIGN PATENT DOCUMENTS

| | | |
|---|---|---|
| EP | 673633 | 9/1995 |

(Continued)

OTHER PUBLICATIONS

Official Letter for Japanese Patent Apllication No. 307,059/2003, with English translation.

*Primary Examiner*—Anthony D. Barfield
(74) *Attorney, Agent, or Firm*—Klarquist Sparkman, LLP

(57) ABSTRACT

A mechanism for supporting and permitting selected adjustment of the position of a headrest relative to the back of a chair comprises a body, a first pivotable connection, a second pivotable connection and a selectively releasable locking mechanism. The first pivotable connection is near the first end of the body, adapted to connect to the chair and to allow pivoting of the body relative to the chair. The second pivotable connection is near the second end of the body, adapted to connect to the headrest and to allow pivoting of the headrest relative to the body. The selectively releasable locking mechanism is configured to retain the body in selected angular positions relative to the chair and relative to the headrest by clamping together interleaved plate members in frictional contact and to allow for one-handed actuation.

22 Claims, 11 Drawing Sheets

U.S. PATENT DOCUMENTS

| | | | |
|---|---|---|---|
| 4,198,094 | A | 4/1980 | Bjerknes et al. |
| 4,266,760 | A | 5/1981 | Matsui et al. |
| 4,366,985 | A | 1/1983 | Leffler |
| 4,375,902 | A | 3/1983 | Tai et al. |
| 4,392,686 | A | 7/1983 | Beer |
| 4,636,004 | A | 1/1987 | Neumüller |
| 4,693,514 | A | 9/1987 | Völkle |
| 4,840,429 | A | 6/1989 | Stockl |
| 4,938,531 | A | 7/1990 | Fogarassy |
| 5,007,678 | A | 4/1991 | DeKraker |
| 5,066,069 | A | 11/1991 | DeGelder |
| 5,328,242 | A | 7/1994 | Steffens et al. |
| 5,520,441 | A | 5/1996 | Citton |
| 5,664,841 | A | 9/1997 | Dal Monte |
| 6,250,716 | B1 | 6/2001 | Clough |
| 6,397,414 | B1 | 6/2002 | Lloyd |

FOREIGN PATENT DOCUMENTS

| | | |
|---|---|---|
| EP | 1186257 | 3/2002 |
| JP | 5694544 | 7/1981 |
| JP | 5793240 | 6/1982 |
| JP | 59097609 | 6/1984 |
| JP | 284541 | 6/1990 |
| JP | 556128 | 7/1993 |
| JP | 7289596 | 11/1995 |
| JP | 9224776 | 9/1997 |
| JP | 2001524182 | 11/2001 |
| JP | 2002176276 | 6/2002 |

* cited by examiner

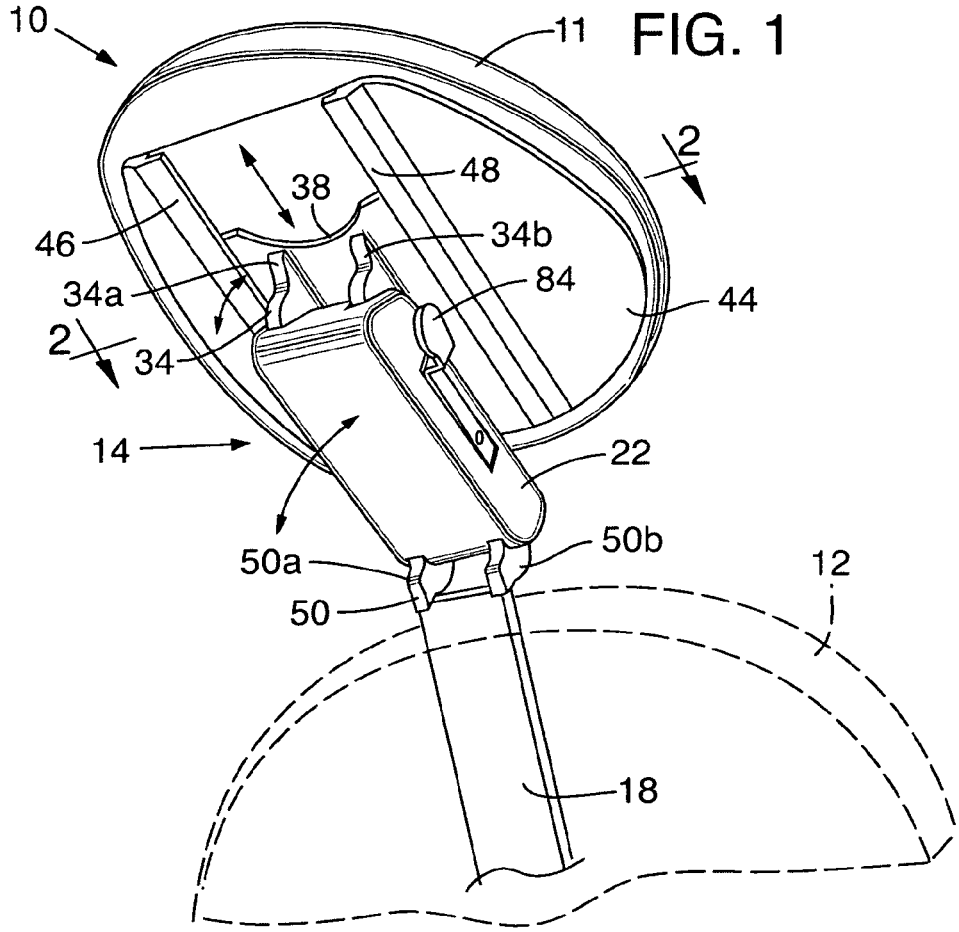
FIG. 1
FIG. 2
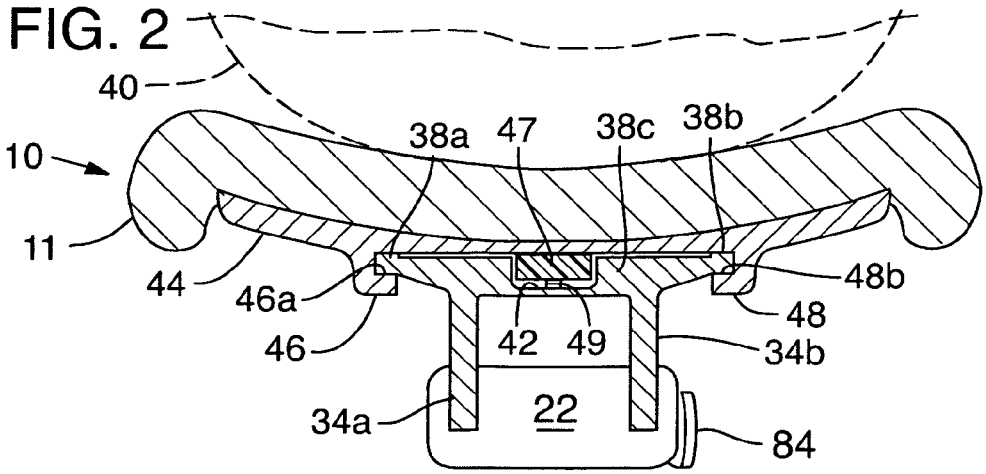

HEADREST SUPPORT AND ADJUSTMENT MECHANISM

RELATED APPLICATIONS

This application is a continuation-in-part of prior U.S. patent application Ser. No. 10/236,687, filed Sep. 5, 2002 now U.S. Pat. No. 6,893,096. The prior application is incorporated herein by this reference.

FIELD

This invention relates to a mechanism for adjustably supporting a headrest relative to a chair back.

BACKGROUND

In many situations, and particularly in medical and dental chair situations, chairs are provided with a back and a headrest which projects above the back. Attempts have been made to produce a comfortable and easily adjusted headrest, but for the most part these have not provided the range of adjustability and ease of use that may be desired.

The headrest often is a somewhat pillow-shaped element spaced from the upper edge of the chair back and needs to be positioned to comfortably cradle the user's head. The comfort and adaptability of the headrest will be determined in great part by its angular position relative to the chair back, its position relative to the plane of the support surface of the chair back, and its distance from the top of the chair back. Each of these may require different positioning due to the characteristics of the user.

Many conventional headrests on chairs, such as dental chairs, are mounted on the chair back through mechanism which provides some degree of adjustability. However, the adjustment may require loosening of a screw-actuated mechanism, adjusting the headrest, and then having to screw the mechanism back to a tightened condition. This often is a two-handed operation and requires more operator time and effort than is desired.

A more desirable mechanism would allow the headrest to be locked in a desired position with the mechanism at rest, be able to be released by a single-hand actuation, with release of the actuator then returning the mechanism to a locked condition.

Further, for matters of hygiene, a plastic bag, or other covering, often is placed over the headrest and actuator mechanism making it difficult to access screw actuators or other conventional adjustment mechanism. Thus, a mechanism which permits one-handed adjustment and which may be easily operated through such a covering would be desirable.

Further, it is desirable to have a headrest support and adjustment mechanism which permits at least two degrees of pivotal freedom. Such would allow the mechanism to be pivoted, or rotated, fore-and-aft relative to the chair back, and then have another adjustment permitting pivoting of the headrest itself relative to remainder portions of the mechanism.

In the past, the height adjustment of the headrest above the chair back generally has been permitted only through a major operating stem which is slidable relative to the chair back and then frictionally held in position. There has been little opportunity for minor adjustment of the height of the headrest once the stem is held in place. A need is apparent for some auxiliary slide mechanism allowing simple raising and lowering of the headrest relative to the chair back which may be accomplished either by the operator or the patient/user of the chair.

Additionally, it has been found that many headrests and headrest adjustment mechanisms are so thick, when measured front-to-back, that when the chair, headrest and patient are laid back to a nearly horizontal position, with the patient's head preferably as close to the operator's (dentist or hygienist) lap as possible, the patient's head still is elevated some distance above the operator's lap. This can produce an inconvenient working position for the operator, requiring that their hands and wrists be placed in undesirable positions. It has been found that the lower the patient's head may be relative to the operator's lap, the more desirable the angle for the operator's hands and wrists. Thus, a thinner mechanism and headrest are desirable to allow such.

Thus it is desirable to provide headrest adjustment mechanism which can be worked through a covering bag, is easy to clean, is simple to operate, is reduced to as small a package as possible to provide good positioning of the patient for the operator to work on, and is operated with a single hand operated manual actuator which requires a minimal amount of force to release the headrest from a lockup position to permit adjustment, yet when the actuator is released, positive locking for the headrest in a desired orientation is provided.

SUMMARY

Described herein are embodiments of the headrest support and adjustment mechanism that address many of the disadvantages of the prior art.

According to one embodiment, a mechanism for supporting and permitting selected adjustment of the position of a headrest relative to a chair to which the headrest is movably attached comprises a body, a first pivotable connection, a second pivotable connection and a selectively releasable locking mechanism. The body has a first end positionable adjacent the chair and a second end positionable adjacent the headrest. The first pivotable connection is near the first end of the body and adapted to connect to the chair and to allow pivoting of the body relative to the chair. The second pivotable connection is near the second end of the body and adapted to connect to the headrest and to allow pivoting of the headrest relative to the body. The selectively releasable locking mechanism is configured to retain the body in selected angular positions relative to the chair and relative the headrest and is configured to allow one-handed actuation. The locking mechanism can be configured to clamp together interleaving plate members in frictional contact.

The mechanism can comprise a set of first plate members pivotally connected adjacent the first pivotable connection and a set of second plate members pivotally connected adjacent the second pivotable connection, with the first plate members extending towards the second plate members with portions of said second plate members being interleaved with portions of the first plate members. The locking mechanism can be configured to clamp the interleaved first and second plate members into locking frictional contact to hold them against movement relative to each other, thereby locking the body in the selected angular positions.

Each of the first and second pivotable connections can be independently pivotable relative to the other.

The mechanism can comprise a headrest plate extendable from the second end of the body and allowing for the headrest to be selectively translated toward and away from the body. The locking mechanism can be positioned approximately coaxially with the first pivotable connection or the second pivotable connection.

The locking mechanism can be a first locking mechanism positioned approximately coaxially with the first pivotable connection, and the mechanism can comprise a second locking mechanism positioned approximately coaxially with the second pivotable connection.

The mechanism can comprise a separating member positioned between at least two of the interleaved first and second plate members in at least one location. The separating member can be a washer with an opening sized to receive a shaft of the locking mechanism.

The mechanism can comprise a set of plate members having a first set of ends pivotally connected adjacent the first pivotable connection and an opposite set of second ends pivotally connected adjacent the second pivotable connection, the locking mechanism being configured to clamp the plate members into locking frictional contact to hold them against movement relative to each other, thereby locking the body in the selected angular positions.

According to another embodiment, a mechanism for supporting and permitting selected adjustment of the position of a headrest relative to a chair to which the headrest is movably attached comprises a body, a first pivotable connection, a second pivotable connection and a selectively releasable locking mechanism with a single actuating member.

The body has a first end positionable adjacent the chair and a second end positionable adjacent the headrest. The first pivotable connection is near the first end of the body and adapted to connect to the chair and to allow pivoting of the body relative to the chair. The second pivotable connection is near the second end of the body and adapted to allow pivoting of the headrest relative to the body. Each of the first and second pivotable connections are independently pivotable relative to the other. While the single actuating member is operated, the first pivot connection is released from a locked position, thereby allowing the body to be pivoted relative to the chair, and the second pivot connection is released from a locked position, thereby allowing the headrest to be pivoted relative to the body. When the actuating member is released, the first pivot connection and the second pivot connection are locked in their respective positions.

According to another embodiment, a mechanism for supporting and permitting selected adjustment of the position of a headrest relative to a back of a chair comprises a body, a first bracket to which a headrest may be connected, the first bracket being pivotally connected at a first pivot adjacent one end of said body, a second bracket for connecting to a chair back, the second bracket being pivotally connected at a second pivot adjacent an end of the body opposite the one end, a set of parallel first plate members pivotally connected adjacent one set of their ends to the first bracket at a third pivot in a region spaced from the first pivot, the first plate members extending toward the opposite end of the body and movable longitudinally, a set of parallel second plate members pivotally connected adjacent one set of their ends to the second bracket at a fourth pivot in a region spaced from the second pivot, the second plate members extending toward the one end of the body and movable longitudinally, with portions of the second plate members being interleaved with portions of the first plate members, a clamping mechanism operable to clamp the interleaved portions of the first and second plate members into locking frictional contact to hold them against movement relative to each other to hold the first and second brackets in selected angular positions relative to the housing, and a release mechanism manually operable to release the clamping mechanism to permit longitudinal movement of the sets of first and second plate members relative to each other and pivotal movement of the first and second brackets relative to the body.

The first plate members can have elongate longitudinally extending first slots formed therein spaced from the third pivot and the second plate members can have elongate longitudinally extending second slots formed therein spaced from the fourth pivot, and the clamping mechanism can comprise an elongate locking member extending transversely of the body and slidably through aligned portions of the first and second slots.

According to another embodiment, a mechanism for supporting and permitting selected adjustment of the position of a headrest relative to a back of a chair comprises a body, a first bracket to which a headrest may be connected, the first bracket being pivotally connected at a first pivot adjacent one end of the body, a second bracket for connecting to a chair back, the second bracket being pivotally connected at a second pivot adjacent an end of the body opposite the one end, a set of parallel first plate members pivotally connected adjacent one set of their ends to the first bracket at a third pivot in a region spaced from the first pivot, the first plate members extending toward the opposite end of the body and movable longitudinally, a set of parallel second plate members having portions interleaved with portions of the first plate members, the second plate members extending toward the one end of the body and movable longitudinally, at least one auxiliary link member having a first end pivotally connected to one set of ends of the second plate members and a second end pivotally connected to the second bracket, a clamping mechanism operable to clamp said interleaved portions of the first and second plate members into locking frictional contact to hold them against movement relative to each other to hold said first and second brackets in selected angular positions relative to the housing, and a release mechanism manually operable to release the clamping mechanism to permit longitudinal movement of the sets of first and second plate members relative to each other and pivotal movement of the first and second brackets relative to the body.

The locking member has a longitudinal axis and the first, second, third and fourth pivots have pivot axes, and the longitudinal axis and the pivot axes can be mutually parallel with one another.

The release mechanism can comprise an elongate lever pivotally connected to the body at a lever pivot and having an operating portion positioned to engage the clamping mechanism and release the clamping mechanism from a locked position. The clamping mechanism can be secured against movement longitudinally of the body to restrict movement of the plate members relative to the body when the clamping mechanism clamps the interleaved portions of the first and second plate members into frictional locking contact.

The body can comprise an elongate housing having opposed spaced apart top and bottom walls and spaced apart opposed side walls defining an enclosure. The housing can have a selected width and height, with the width greater than the height. The first and second plate members can be enclosed in said housing.

The mechanism can comprise a headrest positioning mechanism connected to the first bracket permitting selected movement of the headrest relative to the first bracket and toward and away from the chair back, the positioning mechanism comprising a connector member adapted to be secured to a rear side of the headrest, and the connector member and headrest support bracket having inter-engaging elements thereon permitting translational movement of the connector member relative to the first bracket.

The first bracket or the connector member can have a pair of opposed spaced apart guide portions thereon, and the other of the first bracket and the connector can have a pair of elongate guideways thereon which receive and support the guide portions to permit translational movement of the connector member relative to the first bracket along a path defined by the guideways. There can be a layer of material of reduced frictional characteristic interposed between the inter-engaging elements of the first bracket and the connector member to provide a selected sliding interconnection therebetween. There can be a friction element coupled to the first bracket or the connector member and biasing means yieldably urging the friction element into contact with the other of said first bracket and connector member to provide a selected frictional interconnection therebetween to retain the headrest support bracket and connector member in selected position when no operator force is being applied thereto.

According to another embodiment, a mechanism for supporting and permitting selected adjustment of the position of a headrest relative to a back of a chair, comprises a body, a first bracket to which a headrest may be connected, the first bracket being pivotally connected at a first pivot adjacent one end of the body, a second bracket for connecting to a chair back, the second bracket being pivotally connected at a second pivot adjacent an end of the body opposite the one end, a set of plate members pivotally connected adjacent a first set of their ends to the first bracket at a third pivot in a region spaced from the first pivot and pivotally connected adjacent a second set of their ends to the second bracket at a fourth pivot in a region spaced from the second pivot, a clamping mechanism operable to clamp the plate members into locking frictional contact to hold them against movement relative to each other to hold the first and second brackets in selected angular positions relative to the housing, and a release mechanism manually operable to release said clamping mechanism to permit longitudinal movement of the plate members relative to each other and pivotal movement of the first and second brackets relative to the body, wherein the second bracket is adapted to allow translation of the headrest relative to the bracket.

These and other features will become more apparent as the following description is read in conjunction with the drawings.

BRIEF DESCRIPTION OF THE DRAWINGS

FIG. 1 is a rear perspective view of a headrest support according to an embodiment in the invention, illustrated in conjunction with a back of a chair (in dashed lines).

FIG. 2 is an enlarged cross-sectional view taken generally along the line 2—2 in FIG. 1.

DETAILED DESCRIPTION

Figure 3:
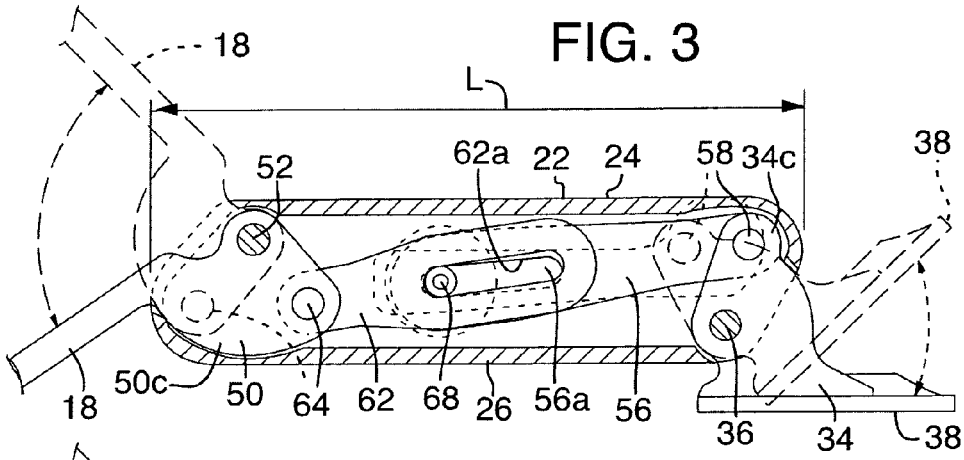
FIG. 3 is a cross-sectional view of a pivotally adjustable support mechanism portion of the headrest support, with mounting brackets at opposite ends thereof shown in first positions in solid outline and in second positions in dashed outline.

Referring to the drawings, and first more specifically to FIG. 1, at 10 as indicated generally a headrest with a cushion 11 supported above a chair back 12 such as would be used in a dental or other medical style chair to support a patient. The headrest is supported above the chair back 12 by adjustment and support mechanism indicated generally at 14 constructed according to an embodiment of the invention.

An elongate slide post, or bar, 18 would be attached to the back of chair 12 by a frictional holding mechanism which allows major raising and lowering of the headrest mechanism. This allows approximate positioning of the headrest but is inconvenient for finer adjustment once the patient is in the chair.

Figure 4:
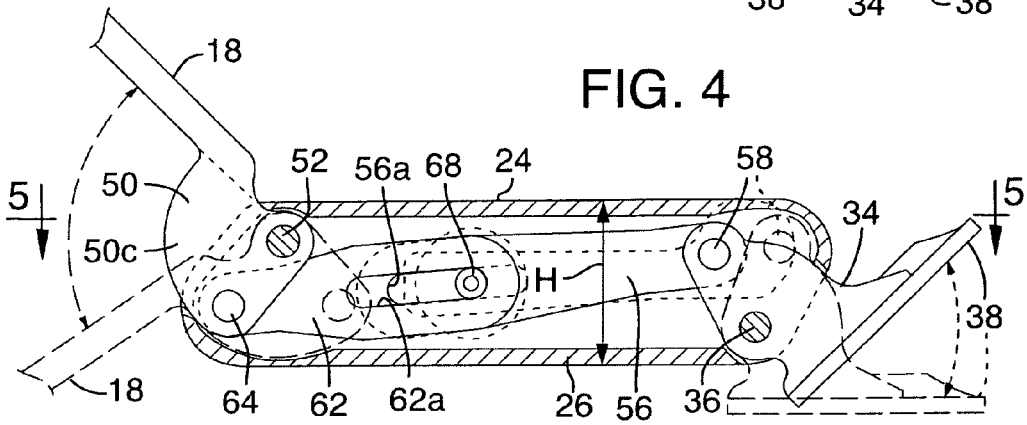
FIG. 4 is a view similar to FIG. 3 with the operating elements therein in reversed operating positions.
Figure 5:
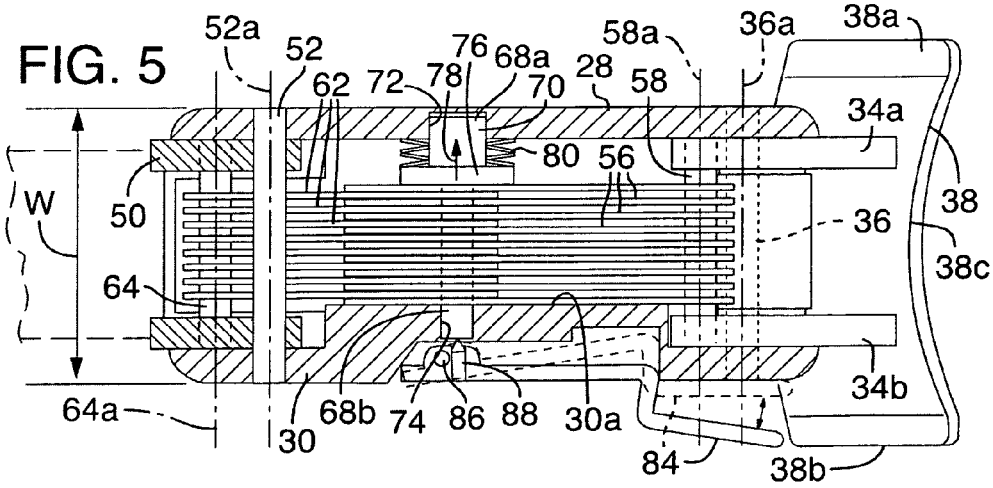
FIG. 5 is a cross-sectional view taken generally along the line 5—5 in FIG. 4.

The adjustment and support mechanism 14 for the headrest according to the invention includes an elongate housing, or mounting body, 22. Referring to FIGS. 3–5, the housing has a selected length L, a selected height H, and a selected width W which are best adapted to provide the operational advantages of the present device. For example, the width W is greater than height H so that appropriate operating mechanism may be accommodated within the housing while still providing a low profile height H to allow patient's head on the headrest to be placed as close to the operator's lap as possible. The support mechanism 14 is show in FIGS. 3–5 in a substantially horizontal orientation which it may assume when a patient is laid back in the chair.

The housing 22 has a substantially planar top wall 24, a substantially planar bottom wall 26, spaced therefrom, and a pair of opposed spaced apart side walls 28,30. The top, bottom and side walls define an enclosure which houses the major portion of the operating components of the apparatus.

A headrest mounting bracket 34 having a pair of bracket arms 34*a*, 34*b* is pivotally connected through pivot connection, or rod, 36 adjacent one end of housing, or body, 22. Pivot connection 36 is spaced outwardly from a central region of housing 22 toward said one end. Pivot connection 36 has an axis 36*a* which extends laterally, or widthwise, of housing 22. Headrest bracket 34 also has a lever arm portion 34*c* thereon which extends laterally from pivot connection 36.

A crossplate, or guide plate, 38 extends across outer edge portions of bracket arms 34*a*, 34*b* and is secured, as by welding, thereto or is cast as a single element with bracket arms 34*a*, 34*b*. The crossplate has opposed outer edge, or margin, portions 38*a*, 38*b* which project laterally outwardly beyond bracket arms 34*a*,34*b* and a central portion 38C as best seen in FIGS. 2 and 5.

As best seen in FIG. 2, cushion 11 of headrest 10 may have a shallow curved configuration to comfortably cradle a patient's head, indicated generally at 40 in dashed line in FIG. 2. A connector plate, or member, 44 may be secured to the back of cushion 11 and, as best seen in FIG. 2, has a shallow curved configuration which conforms to, or is complementary to, the curved configuration of cushion 11. Connector plate 44 has laterally spaced apart parallel guide rail portions 46,48 extending longitudinally of the connector plate and forming channels, or guideways, 46*a*,48*b* adapted to slidably receive edge margin portions 38*a*,38*b*, respectively, of crossplate 38 therein. Channels 46*a*,48*b* act as guideways to mount connector plate 44 on headrest bracket 34 and permit translational sliding movement relative thereto. Explaining further, a sliding fit is provided between edge margins 38*a*,38*b* and channels 46*a*,48*b* permitting the headrest connector plate 44 and the headrest cushion connected thereto to be slid along crossplate 38 toward and away from chair back 12.

To improve the operation of this translational sliding movement, appropriate materials may be interposed between edge margin portions 38*a*, 38*b* and channels 46*a*, 48*b* to provide a selected sliding fit therebetween. The fit should be such that an operator or patient may easily slide the headrest up or down to produce the most convenient or comfortable position desired. A layer of a material such as DELRIN (produced by E.I. Dupont De Nemours) has been found to work well as an interface in the channels between edge margin portions 38*a*, 38*b* and channels 46*a*, 48*b*. This, or other material appropriate to provide the desired sliding fit, may be applied either to edge margin portions 38*a*, 38*b* or to the interiors of channels 46*a*, 48*b*.

Referring still to FIG. 2, a cavity 42 is formed in central section 38*c* of crossplate 38 facing toward connector plate 44. A friction plate 47, which may be in the form of a block of NYLATRON (produced by Polymer Corporation) is situated in cavity 42 with a spring 49 biasing it outwardly toward connector plate 44. The biasing force of spring 49 urging friction plate 47 outwardly and against connector plate 44 serves to produce a selected frictional holding of the connector plate relative to the crossplate such that the headrest cushion will be held in a selected position once it is placed as desired by the user.

A back support bracket 50 to which post 18 is secured, as by welding or other means, is pivotally connected to housing 22 through a pivot connection, or rod, 52 adjacent the end of housing 22 opposite bracket 34. Pivot connection 52 is spaced outwardly from a central region of housing 22 toward the opposite end. The pivot connection 52 has an axis 52*a* which extends laterally, or widthwise, of housing 22.

Bracket 50 includes a pair of laterally spaced bracket arms 50*a*, 50*b*. Bracket arms 50*a*, 50*b* project outwardly from their associated end of housing 22 through openings defined in housing 22, as do bracket arms 34*a*, 34*b*, at the opposite end of the housing. Bracket 50 has a lever arm portion indicated generally at 50*c* which projects laterally of pivot connection 52.

A plurality of elongate substantially planar parallel plate members, or fingers, also referred to herein as friction plates, 56 are disposed in a set. They are pivotally connected adjacent their outer set of ends at a pivot connection 58, or rod, 58 to lever arm 34*c* of bracket 34. The axis 58*a* of the pivot connection extends transversely, or widthwise, of housing 22. Remainder portions of plate members 56 extend longitudinally through a major portion of the interior of the enclosure provided by housing 22 toward the opposite end of the housing.

Elongate slots 56*a* are formed in plates 56 extending longitudinally thereof. These slots extend toward the opposite, or inner, ends of plates 56 spaced from the end portion connected to pivot connection 58. Plate members 56 and their respective slots 56*a* are aligned transversely, or widthwise, of housing 22.

A plurality of elongate parallel substantially planar plate members, or fingers, also referred to as friction plates, 62 are disposed in a set with their outer ends pivotally connected at a pivot connection, or rod, 64 extending transversely, or widthwise, of housing 22. The axis 64*a* of pivot connection 64 extends transversely, or widthwise, of housing 22. Plates 62 are connected to lever arm 50*c* in a region spaced from pivot connection 52 for bracket 50.

Remainder portions of plate members 62 extend longitudinally through the enclosure of housing 22 toward the end occupied by bracket 34. Plate members 62 have elongate longitudinally extending slots 62*a* formed therein which extend to a region adjacent their inner ends. Plate members 62 and their respective slots 62*a* are aligned transversely, or widthwise, of housing 22.

As best seen in FIG. 5, the inner end portions of the sets of plate members, fingers, 56 and 62 are interleaved in a mid-region of housing 22.

In the interleaved region portions of slots 56*a*, 62*a* are aligned. An elongate rod portion 68 of a locking, or clamping, mechanism indicated generally at 70, extends laterally and slidably through aligned portions of slots 56*a*, 62*a*. Rod portion 68 assists in maintaining alignment of the plate members as they move within the housing. Rod 68 has an enlarged cylindrical head portion 68*a* received in a cavity 72 formed in side wall 28. The opposite end portion 68*b* of rod 68 extends into a throughbore 74 in side wall 30.

An enlarged bearing member, or portion, 76 secured to rod 68 is mounted for reciprocating movement in the direction of arrow 78 and is positioned to bear against a laterally outwardly facing side of one of the plate members. In FIG. 5, it bears against an outer facing surface of a plate member 56. Rod 68 and member 76 are held against movement longitudinally of housing 22.

A plurality of stacked spring washers, or Bellville springs, indicated generally at 80 are interposed between side wall 28 of the housing and bearing member 76. These urge the bearing member away from wall 28 and into forceful bearing contact with the plate members. This forces the interleaved portions of the plate members into clamping engagement between bearing member 76 and the inner, or abutment, surface 30*a* of side wall 30. The forceful clamping of bearing member 76 against the interleaved portions of fingers 56,62 clamps them into frictional locking engagement such that they are held in the position shown. Since the outer end portions of the plate members 56,62 are connected to bracket members 34,50, this frictional locking will hold the brackets in their given positions, thus holding the adjustment mechanism in position relative to slide bar support 18 and holding headrest 10 in selected angular position relative to housing 22.

Depending upon the particular operating requirements, including the number, size, and surface finish of the plate members 56,62 and the clamping force that can be applied to them, it may be desirable in some situations to interpose washers or other thin separating structures between adjacent plate members 56,62 at least in the area of their overlap where the clamping force is applied. Such a washer 90 or separating structure is shown schematically in, e.g., FIG. 7. In practice, any washer 90 or other separating structure can be quite thin, e.g., even 10% or less of the thickness of the plate members 56,62.

Release mechanism including a lever 84 is provided to release the frictional clamping force and allow the plate members, or fingers, to move longitudinally relative to the housing and relative to each other to permit rotation of and changing of the angularity of brackets 34 and 50 relative to housing 22.

The elongate lever 84 is pivotally connected at 86 to housing 22 and has an engaging projection 88 thereon closely adjacent pivot connection 86. When the lever is in the position illustrated in solid outline in FIG. 5, it has substantially no effect on the clamping mechanism and thus the clamping mechanism frictionally locks the plate members in position. Swinging of the lever member to the dashed outline position illustrated in FIG. 5, causes projection 88 to engage end portion 68*b* of rod 68 and force the rod and bearing member 76 away from clamping engagement with the plate members against the biasing force of springs 80. When the clamping force is thus released by swinging movement of the lever, the plate members are released allowing relative sliding movement therebetween. This permits rotational swinging of bracket 34 and bracket 50 relative to housing 22 to change the angular position of headrest 10. Release of lever 84 returns the mechanism to its locked up position.

The range of pivotal movement of brackets 34,50 and the commensurate longitudinal shifting of their associated fingers 56,62, respectively, are illustrated in FIGS. 3 and 4.

Explaining operation of the apparatus, the operator initially places headrest slide support, or rod, 18 in a selected position relative to the back rest. When a patient, or user, enters the chair, the operator may depress lever 84 easily with one-handed operation due to its significant mechanical advantage provided by the long lever arm to release the clamping lock of the fingers. With the clamping lock thus released, the angular positions of portions of the assembly may be easily adjusted to conform to the patient. Release of the lever returns the mechanism to a locked position.

When the user, or patient, is seated in the chair their back rests against the plane of the user-engaging surface of the chair back. When the clamping mechanism is released, housing 22 may be swung rearwardly or forwardly about its pivot axis 52 to swing the headrest relative to the plane of the user-engaging surface of the chair back. At the same time, the angle of head rest support bracket 34 may be swung about its pivot axis 36 to a selected angular position relative to housing 22. This is all permitted by longitudinal movement of plate members 56,62 within the housing when the clamping mechanism is released. In this way, the headrest may be positioned as desired for the most comfortable disposition for the user and convenient positioning for the operator.

Similarly, once the patient is situated, the slide mechanism connected to the back of the headrest allows the headrest to be easily slid up and down relative to the chair back to obtain desired vertical positioning.

Figure 6A:
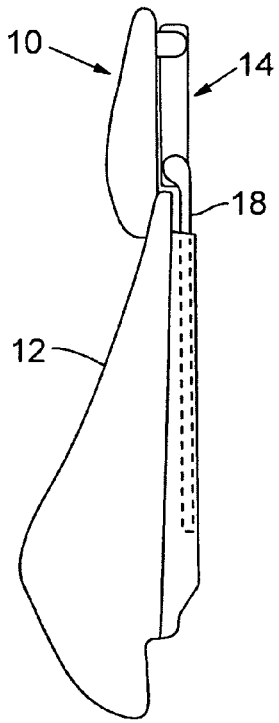
FIGS. 6A, 6B, 6C, 6D and 6E are schematic side views showing the headrest support in various positions to illustrate its range of motion and use.

FIGS. 6A, 6B, 6C, 6D and 6E are schematic side views showing the headrest 10 in various positions to illustrate further its range of motion and use. In FIG. 6A, the headrest 10 is shown in a compact state with the slide bar support 18 retracted and the headrest positioned to overlap an upper edge of the chair back 12. In the illustrated implementation, the chair back 12 has curved cross-section terminating in side edges that curve outwardly from the center back area, as shown in the figures. With the headrest 10 in the compact state, the mechanism 14 (which can have a generally enclosed housing) is generally aligned with the slide bar 18 in the illustrated implementation.

Figure 6B:
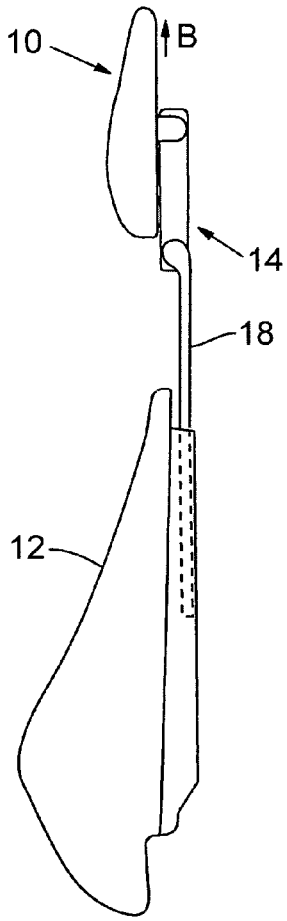

In FIG. 6B, the slide bar support 18 has been extended to position the headrest 10 away from the chair back 12. In addition, the head rest 10 has been translated in the direction of arrow B relative to the mechanism 14.

Figure 6C:
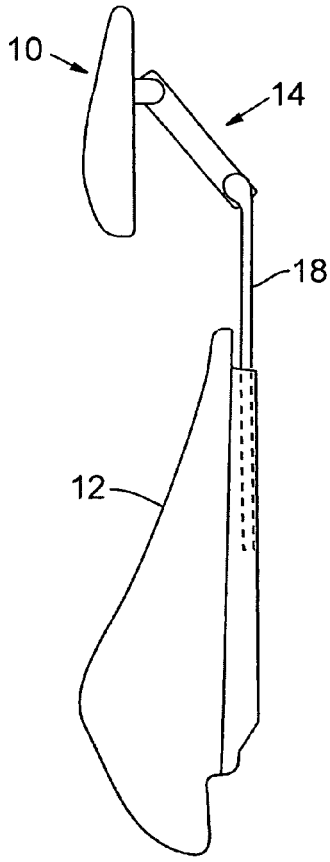

In FIG. 6C, the mechanism 14 has been adjusted to position the head rest 10 outward from the plane of the slide bar support 18. In the illustrated implementation, the head rest 10 has been maintained generally parallel to the slide bar support 18.

Figure 6D:
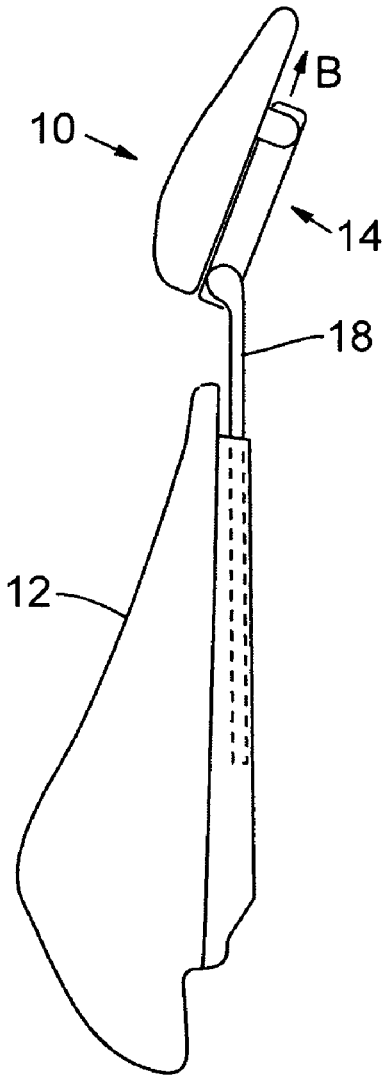

In FIG. 6D, the slide bar support 18 has been partially retracted and the head rest 10 has been translated in the direction of arrow B relative to its position in the compact state. In addition, the mechanism 14 has been adjusted to position the headrest 10 at an angle relative to the slide bar support.

Figure 6E:
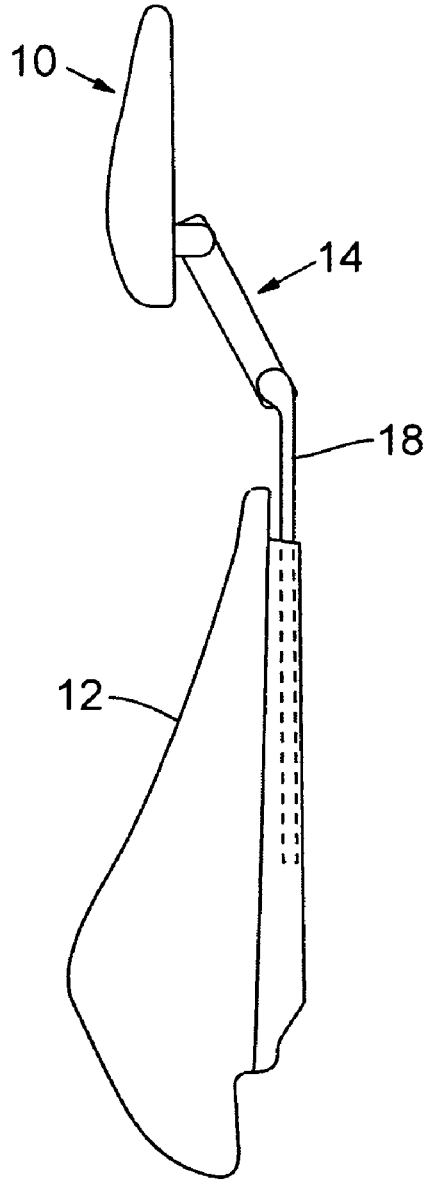

In FIG. 6E, the slide bar support 18 is in approximately the same position as shown in FIG. 6D. The mechanism 14 has been pivoted to position the head rest 10 generally parallel to the slide bar support 18 and spaced outwardly from the plane of the chair back 12.

Figure 6F:
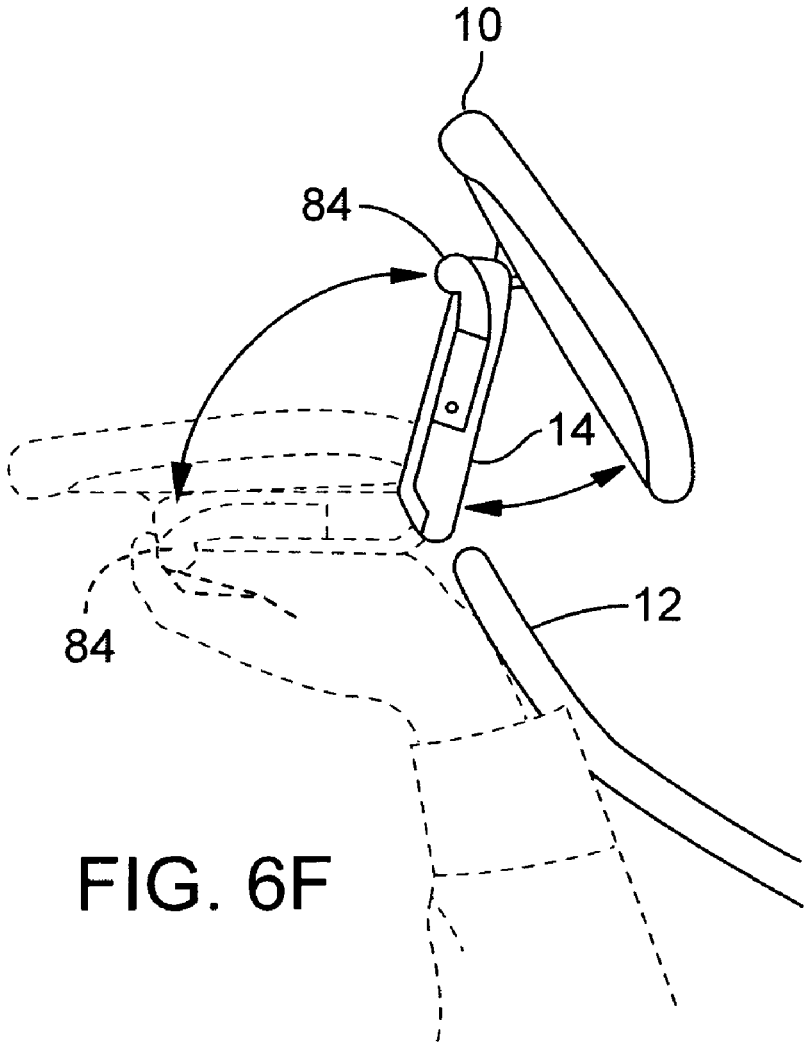
FIG. 6F is a schematic view showing the position of the headrest support being adjusted with one hand.

FIG. 6F shows the one-handed operation capability in more detail. Specifically, FIG. 6F shows an operator's left hand depressing the lever 84, thereby releasing the locking mechanism to allow its body and the headrest 10 attached to the body to be repositioned within the ranges as shown schematically by the arrows in the figure.

Figure 7A:
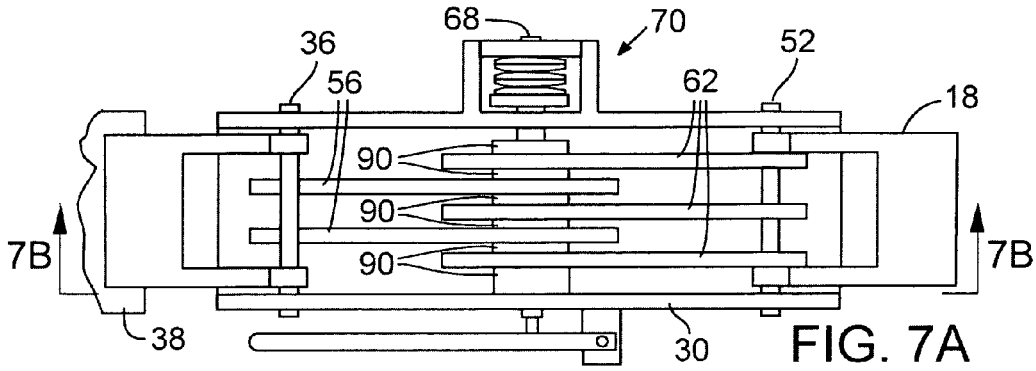
FIGS. 7A, 7B and 7C are plan, sectioned elevation and sectioned plan views, respectively, of a variant of the support mechanism similar to FIGS. 4 and 5, except the pivot positions have been reversed.
Figure 7B:
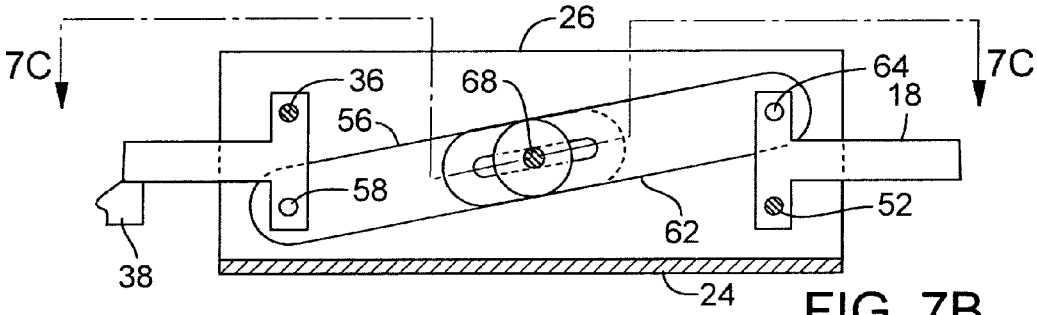
Figure 7C:
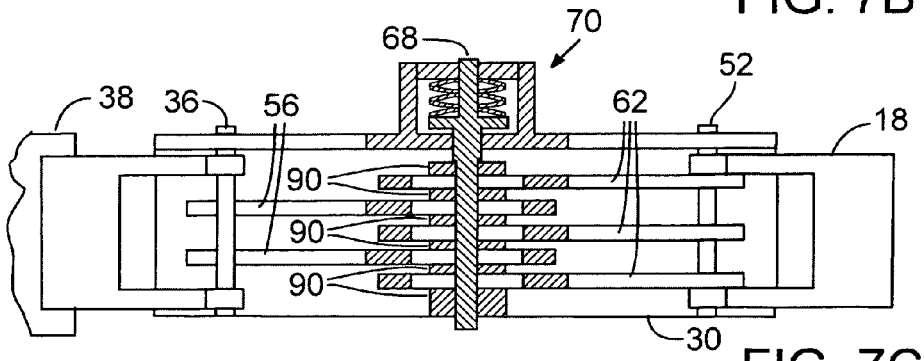

FIGS. 7A, 7B and 7C show an alternative embodiment of the head rest support mechanism. FIG. 7A is similar to FIG. 5 in that the internal elements of the mechanism 10 are shown, but it is viewed from the opposite side and schematically depicts an arrangement where the pivot connections 36,52 are reversed from the relative positions shown in FIG. 5. In other words, the pivot connection 52 that connects to the slide bar support is positioned closer to the top wall 24 (FIG. 7B) than as shown in FIG. 5. Similarly, the pivot connection 36 that connects to the cross plate 38 is spaced closer to the bottom wall 26 (FIG. 7B) than as shown in FIG. 5. For convenience of illustration, only two plate members 56 and three plate members 62 are shown in FIGS. 7A and 7C, but of course any number of plate members can be provided depending upon operating requirements. As described above, washers 90 can be provided between adjacent plate members 56,62, particularly in the area of the rod 68.

Figure 8A:
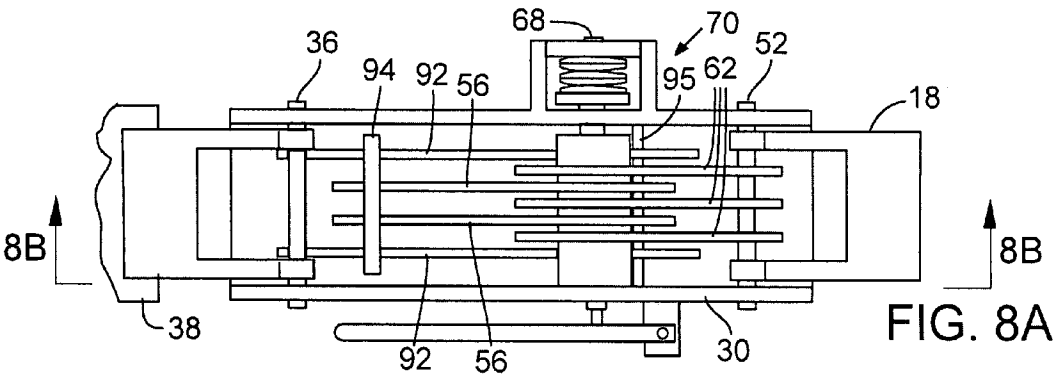
FIGS. 8A, 8B and 8C are plan, sectioned elevation and sectioned plan views, respectively, of a variant of the support mechanism similar to FIGS. 4 and 5, except the linkage includes additional components and has a different configuration.
Figure 8B:
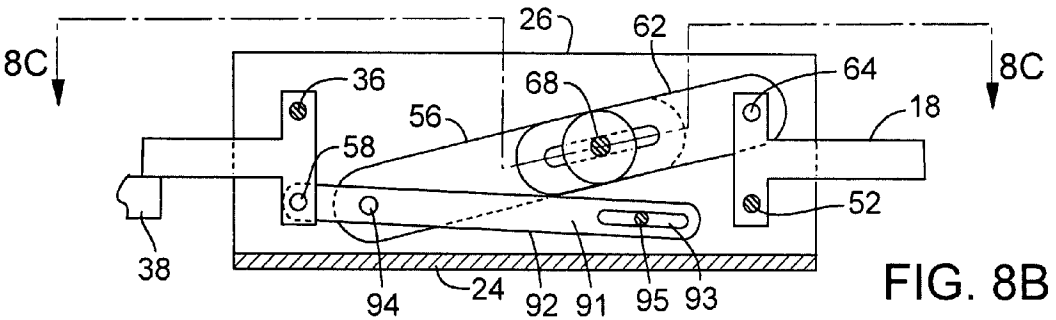
Figure 8C:
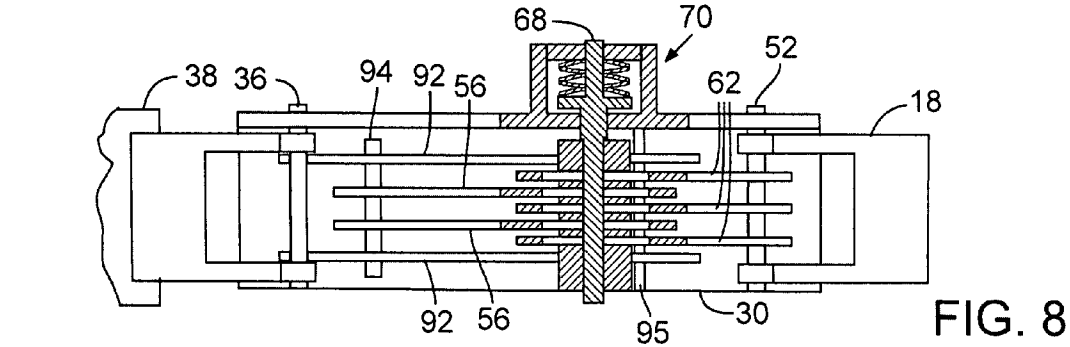

FIGS. 8A, 8B and 8C show an alternative embodiment similar to FIGS. 7A–7C, except the linkage includes an additional link 91 (FIG. 8B). The link 91 may be comprised of multiple link members 92 (FIGS. 8A and 8C), similar to the plate members 56,62. The link members 92 have slots 93 that connect the link 91 and allow it to move relative to a stationary pivot 95. From right to left in FIG. 8B, the pivot connection 52 to the slide bar support 18 is stationary or grounded, the pivot connection 64 between the slide bar support 18 and the plate members 62 is free to move, the pivot connection 68 at the inner ends of the plate members 62 to the inner ends of the plate members 56 is stationary, the pivot connection 94 at the outer ends of the plate members 56 to the link 91 is free to move, the pivot connection 58 connecting the other end of the link 91 and the cross plate 38 is free to move, and the pivot connection 36 to the cross plate 38 is fixed. Movement of the link 91 is constrained by the stationary pivot 95 and the length of the slots 93. The addition of the link 91 provides additional degrees of freedom in positioning the cross plate, and thus the head rest 10, relative to the chair back attached to the support rod at 18. Although not illustrated, other embodiments employing additional links are also possible.

Figure 9A:
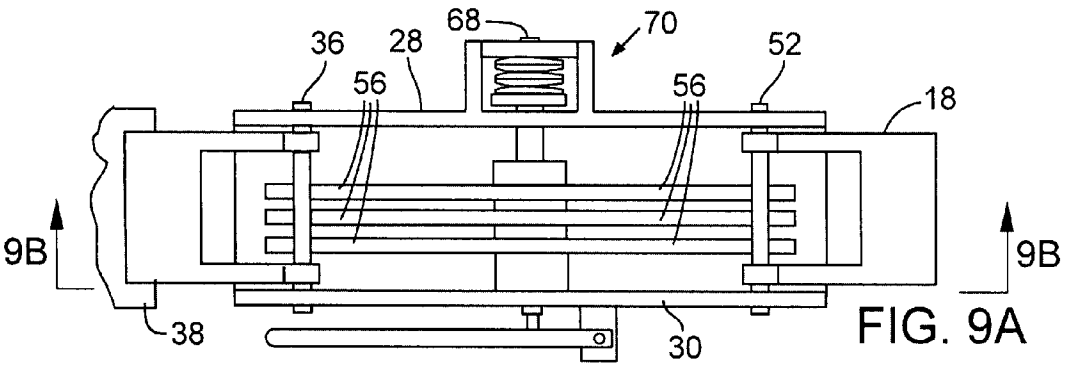
FIGS. 9A, 9B and 9C are plan, sectioned elevation and sectioned plan views, respectively, of a variant of the support mechanism similar to FIGS. 4 and 5, except the linkage has a single set of continuous links rather than two discrete sets of links.
Figure 9B:
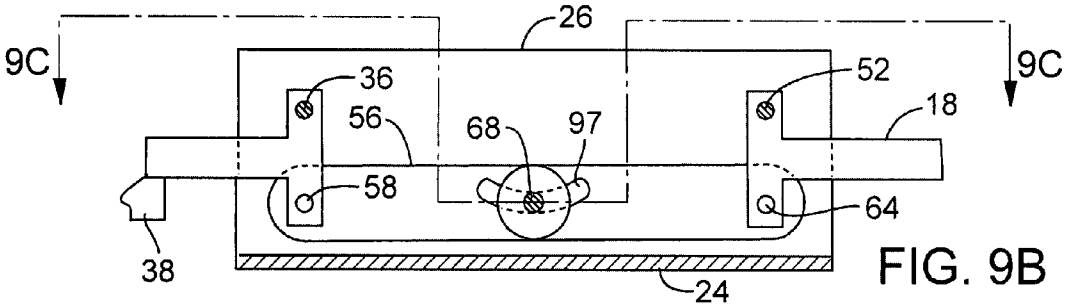
Figure 9C:
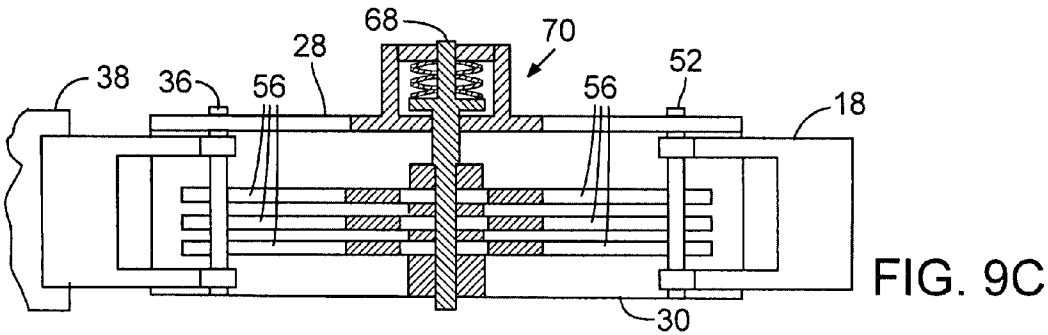

FIGS. 9A, 9B and 9C show an alternative embodiment similar to FIGS. 7A–7C, except that the pivot connections 36,52 are each positioned closest to the same side of the housing, in this case the bottom wall 26, and the two sets of plate members 56,62 have been replaced by a single set of plate members 56 with curved slots 97. The curved slots constrain the motion of the plate members 56 relative to the pivot connection 68. In this embodiment, the positions of the slide bar support 18 and the cross bar 38 are not independent of each other. Although the embodiment of FIGS. 9A–9C provides less freedom in positioning the headrest 10 compared to other embodiments in this application, the additional ability to translate the headrest 10 relative to the mechanism allows for sufficient flexibility of positioning for many situations.

Figure 10A:
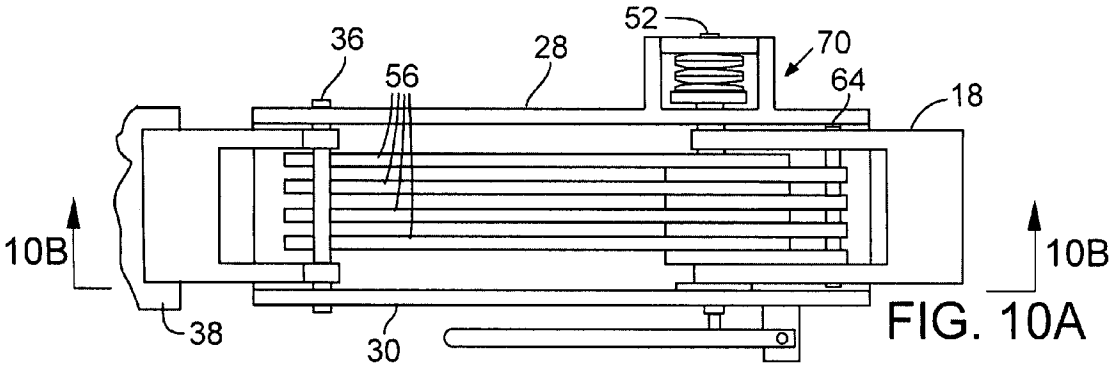
FIGS. 10A, 10B and 10C are plan, sectioned elevation and sectioned plan views, respectively, of a variant of the support mechanism similar to FIGS. 4 and 5, except the release mechanism is positioned coaxially with one of the pivots instead of between the pivots.
Figure 10B:
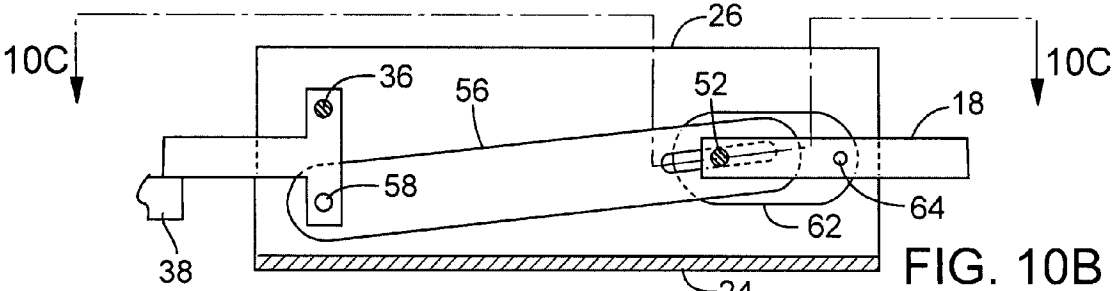
Figure 10C:
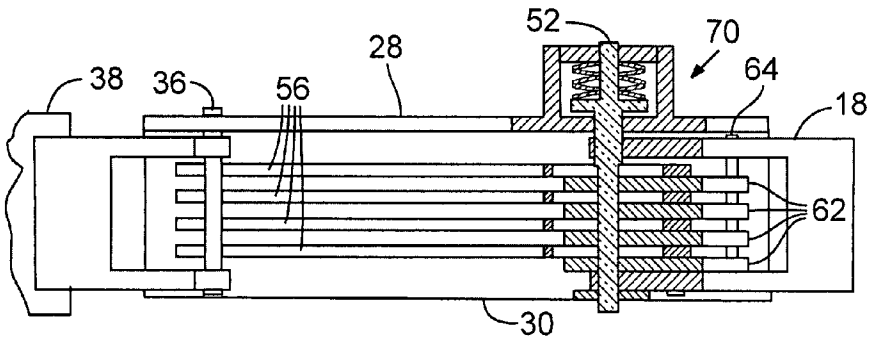

FIGS. 10A, 10B and 10C show an alternative embodiment similar to FIGS. 7A–7C, except that the locking mechanism 70 is positioned coaxially with the pivot connection 52 for the slide bar support 18, rather than between the pivot connections 36,52 as shown in FIGS. 7A and 7B. Of course, in another variation it would also be possible to position the locking mechanism coaxially with the pivot connection 36. As illustrated, the plate members 62 are constrained only to pivot and, unlike the embodiment of FIGS. 7A and 7B, they cannot translate relative to the locking mechanism 70.

Figures 11A, 11B, 11C:
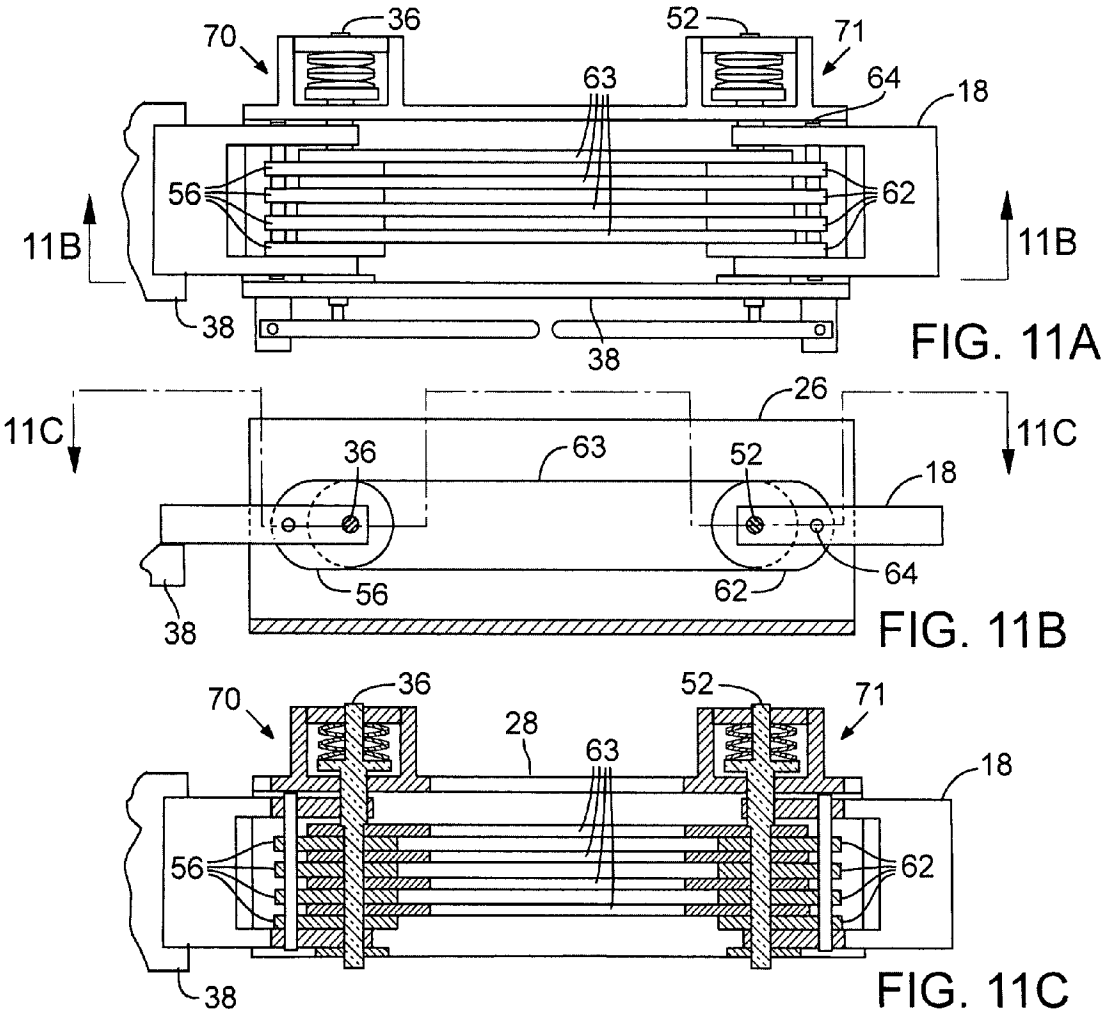
FIGS. 11A, 11B and 11C are plan, sectioned elevation and sectioned plan views, respectively, of a variant of the support mechanism similar to FIGS. 4 and 5, except there are two independently operable release mechanisms.

FIGS. 11A, 11B and 11C show an alternative embodiment similar to FIGS. 7A–7C, except that in addition to the locking mechanism 70, there is a second, separate locking mechanism 71. Also, there is a set of plate members 63, which are generally stationary in this example, that are interleaved at one set of their ends with the plate members 56 adjacent the pivot connection 36, and at the opposite set of their ends with the plate members 62 adjacent the pivot connection 52. Of course, the single set of plate members 63 could be replaced by two shorter sets, with each of the shorter sets having one end interleaved.

As shown in FIGS. 11A and 11B, the locking mechanisms 70,71 can be positioned coaxially with the pivot connections 36,52, respectively. With the embodiment of FIGS. 11A and 11B, adjusting the position relative to the cross plate 38 and adjusting the position relative to the slide bar support 18 requires actuation of the separate locking mechanisms. The actuator handles may be positioned to allow for one-handed actuation of both locking mechanisms 70,71, such as shown in FIG. 11A.

Figure 12A:
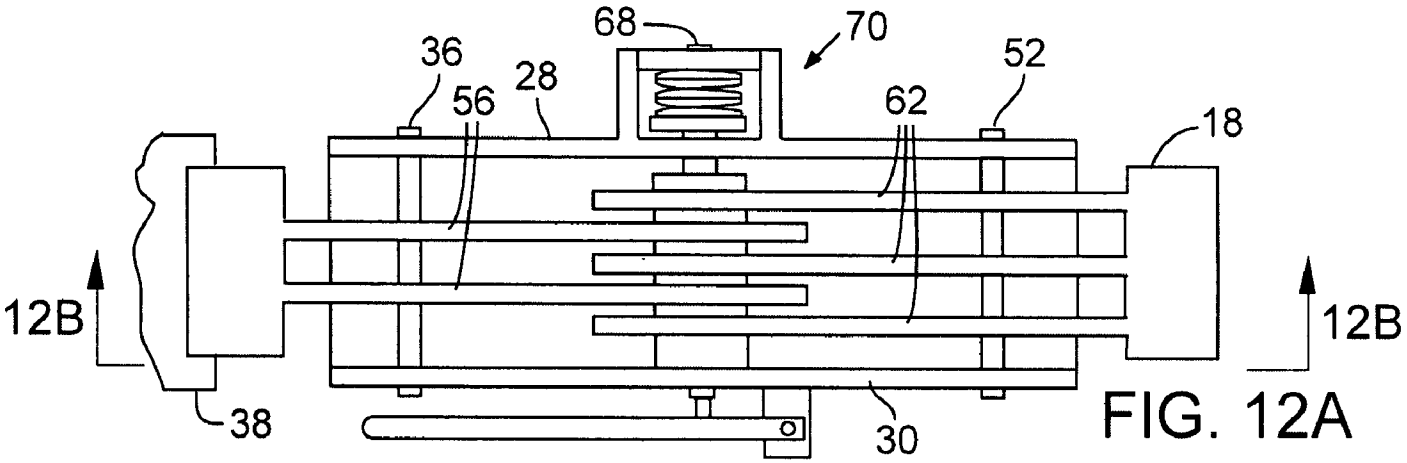
FIGS. 12A and 12B are plan and sectioned elevation views, respectively, of a variant of the support mechanism similar to FIGS. 4 and 5, except that there are single pivots at the ends and the interleaved members have complimentary curved slots where they overlap in the area of the release mechanism.
Figure 12B:
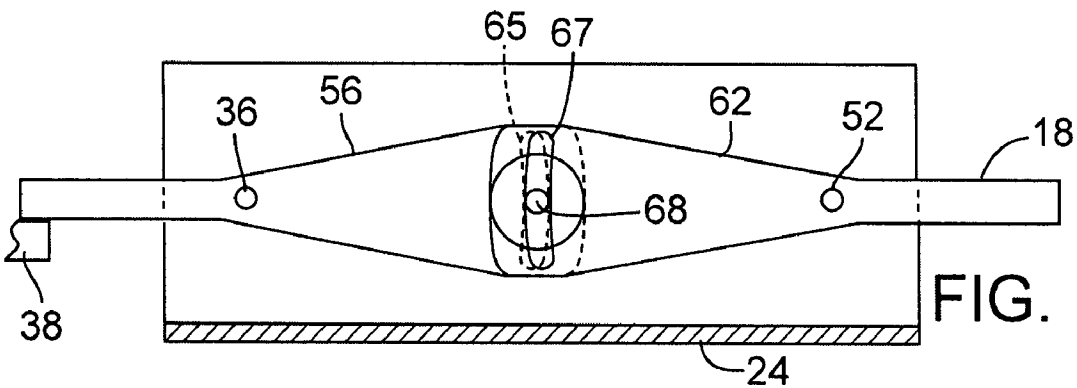

FIGS. 12A and 12B show an alternative embodiment similar to FIGS. 4 and 5, except that there are single pivots at the ends and the interleaved plate members have complimentary curved slots where they overlap in the area of the release mechanism. Specifically, the plate members 56 connected to the cross plate 38 are pivotable about the single pivot connection 36, and the plate members 62 connected to the slide bar support 18 are pivotable about the single pivot connection 52. The plate members 56,62 have complimenting curved slots 65,67, respectively, positioned near their inner ends. The slots 65,67 overlap as shown and define the pivot ranges. The slots 65,67 receive and allow the plate members 56,62 to move relative to the locking mechanism 70. Although the embodiment of FIGS. 12A and 12B as illustrated may provide slightly less freedom in positioning the headrest 10 compared to other embodiments, particularly those with more pivots, the mechanism provides sufficient flexibility of positioning for many situations. In addition, the positions of the pivots, the lengths of the plate members and the slots and other geometrical relationships can be adapted as necessary to yield a sufficient range of motion.

The configuration of housing 22 and the operating mechanism mounted therein for permitting adjustment of the headrest and locking such in a selected position, has a relatively thin profile, or height H, allowing the patient's head to be placed closely adjacent the operator's lap. Further, the enclosed housing provides a protective casing for the operating mechanism which permits ease of operation, cleaning, and positioning. Other advantages include the ability to configure the assembly to default to a locked position so the head rest does not move unexpectedly, the ability to operate the mechanism with one hand and while the mechanism is covered, such as with plastic or other sterile covering, the ability to adjust the position while the patient is occupying the chair, and the ability to accommodate patients of all sizes, including children.

In the illustrated embodiments, the selective locking into desired positions for use of the headrest is achieved using a locking mechanism that releasably secures interleaved plate members in place relative to each other. Other mechanisms are also possible, including but not limited to belt arrangements and locking members with nesting cone- or hemispherical-shaped elements. It would also be possible to provide the a powered locking force with fluid, electricity, magnetism, etc.

While preferred embodiments have been described herein, it should be apparent to those skilled in the art that variations and modifications are possible without departing from the spirit of the invention.

We claim:

1. A mechanism for supporting and permitting selected adjustment of the position of a headrest relative to a chair to which the headrest is movably attached, the mechanism comprising:

a body having a first end positionable adjacent the chair and a second end positionable adjacent the headrest;

a first pivotable connection near the first end of the body and adapted to connect to the chair and to allow pivoting of the body relative to the chair;

a second pivotable connection near the second end of the body and adapted to connect to the headrest and to allow pivoting of the headrest relative to the body, each of the first and second pivotable connections being independently pivotable relative to the other; and a selectively releasable locking mechanism configured to retain the body in selected angular positions relative to the chair and relative the headrest, the locking mechanism being configured to allow one-handed actuation and comprising interleaving plate members that can be clamped in frictional contact with each other;

wherein the interleaving plate members comprise a set of first plate members pivotally connected adjacent the first pivotable connection and a set of second plate members pivotally connected adjacent the second pivotable connection, the first plate members extending towards the second plate members with portions of said second plate members being interleaved with portions of said first plate members, and the locking mechanism being configured to clamp the interleaved first and second plate members into locking frictional contact to hold them against movement relative to each other, thereby locking the body in the selected angular positions.

2. The mechanism of claim 1, further comprising a headrest plate extendable from the second end of the body and allowing for the headrest to be selectively translated toward and away from the body.

3. The mechanism of claim 1, wherein the locking mechanism is positioned approximately coaxially with the first pivotable connection or the second pivotable connection.

4. The mechanism of claim 3, wherein the locking mechanism is a first locking mechanism positioned approximately coaxially with the first pivotable connection, further comprising a second locking mechanism positioned approximately coaxially with the second pivotable connection.

5. The mechanism of claim 1, further comprising a separating member positioned between at least two of the interleaved first and second plate members in at least one location.

6. The mechanism of claim 5, wherein the separating member is a washer with an opening sized to receive a shaft of the locking mechanism.

7. The mechanism of claim 1, further comprising a set of plate members having a first set of ends pivotally connected adjacent the first pivotable connection and an opposite set of second ends pivotally connected adjacent the second pivotable connection, the locking mechanism being configured to clamp the plate members into locking frictional contact to hold them against movement relative to each other, thereby locking the body in the selected angular positions.

8. A mechanism for supporting and permitting selected adjustment of the position of a headrest relative to a chair to which the headrest is movably attached, the mechanism comprising:

a body having a first end positionable adjacent the chair and a second end positionable adjacent the headrest;

a first pivotable connection near the first end of the body and adapted to connect to the chair and to allow pivoting of the body relative to the chair;

a second pivotable connection near the second end of the body and adapted to allow pivoting of the headrest relative to the body, each of the first and second pivotable connections being independently pivotable relative to the other;

a selectively releasable locking mechanism comprising interleaving plate members and a single actuating member coupled to the body, wherein while the actuating member is operated, the first pivot connection is released from a locked position, thereby allowing the body to be pivoted relative to the chair, and the second pivot connection is released from a locked position, thereby allowing the headrest to be pivoted relative to the body, and wherein when the actuating member is released, the first pivot connection and the second pivot connection are locked in their respective positions; and a headrest positioning mechanism disposed adjacent the second end permitting selected translational movement of the headrest relative to the chair.

9. A mechanism for supporting and permitting selected adjustment of the position of a headrest relative to a back of a chair, the mechanism comprising a body, a first bracket to which a headrest may be connected, said first bracket being pivotally connected at a first pivot adjacent one end of said body, a second bracket for connecting to a chair back, said second bracket being pivotally connected at a second pivot adjacent an end of said body opposite said one end, a set of parallel first plate members pivotally connected adjacent one set of their ends to said first bracket at a third pivot in a region spaced from said first pivot, said first plate members extending toward the opposite end of the body and movable longitudinally, a set of parallel second plate members pivotally connected adjacent one set of their ends to said second bracket at a fourth pivot in a region spaced from said second pivot, said second plate members extending toward said one end of the body and movable longitudinally, with portions of said second plate members being interleaved with portions of said first plate members, a clamping mechanism operable to clamp said interleaved portions of said first and second plate members into locking frictional contact to hold them against movement relative to each other to hold said first and second brackets in selected angular positions relative to the housing, and a release mechanism manually operable to release said clamping mechanism to permit longitudinal movement of said sets of first and second plate members relative to each other and pivotal movement of said first and second brackets relative to said body.

10. The mechanism of claim 9, wherein the first plate members have elongate longitudinally extending first slots formed therein spaced from the third pivot and said second plate members have elongate longitudinally extending second slots formed therein spaced from the fourth pivot, and wherein the clamping mechanism comprises an elongate locking member extending transversely of said body and slidably through aligned portions of said first and second slots.

11. The mechanism of claim 9, wherein the first plate members have first through slots and the second plate members have second through slots, and wherein the clamping mechanism is dimensioned to pass through the overlapped first and second through slots.

12. A mechanism for supporting and permitting selected adjustment of the position of a headrest relative to a back of a chair, the mechanism comprising a body, a first bracket to which a headrest may be connected, said first bracket being pivotally connected at a first pivot adjacent one end of said body, a second bracket for connecting to a chair back, said second bracket being pivotally connected at a second pivot adjacent an end of said body opposite said one end, a set of parallel first plate members pivotally connected adjacent one set of their ends to said first bracket at a third pivot in a region spaced from said first pivot, said first plate members extending toward the opposite end of the body and movable longitudinally, a set of parallel second plate members having portions interleaved with portions of said first plate members, the second plate members extending toward said one end of the body and movable longitudinally, at least one auxiliary link member having a first end pivotally connected to one set of ends of the second plate members and a second end pivotally connected to the second bracket, a clamping mechanism operable to clamp said interleaved portions of said first and second plate members into locking frictional contact to hold them against movement relative to each other to hold said first and second brackets in selected angular positions relative to the housing, and a release mechanism manually operable to release said clamping mechanism to permit longitudinal movement of said sets of first and second plate members relative to each other and pivotal movement of said first and second brackets relative to said body.

13. The mechanism of claim 12, wherein said locking member has a longitudinal axis and said first, second, third and fourth pivots have pivot axes, and wherein the longitudinal axis and pivot axes are mutually parallel with one another.

14. The mechanism of claim 12, wherein said release mechanism comprises an elongate lever pivotally connected to said body at a lever pivot and having an operating portion positioned to engage said clamping mechanism and release said clamping mechanism from a locked position.

15. The mechanism of claim 12, wherein said clamping mechanism is secured against movement longitudinally of said body to restrict movement of said plate members relative to said body when said clamping mechanism clamps said interleaved portions of said first and second plate members into frictional locking contact.

16. The mechanism of claim 12, wherein said body comprises an elongate housing having opposed spaced apart top and bottom walls and spaced apart opposed side walls defining an enclosure, said housing having a selected width and height, with the width greater than the height.

17. The mechanism of claim 16, wherein said first and second plate members are enclosed in said housing.

18. The mechanism of claim 12, further comprising a headrest positioning mechanism connected to said first bracket permitting selected movement of the headrest relative to said first bracket and toward and away from the chair back, said positioning mechanism comprising a connector member adapted to be secured to a rear side of the headrest, and said connector member and headrest support bracket having inter -engaging elements thereon permitting translational movement of said connector member relative to said first bracket.

19. The mechanism of claim 18, wherein one of said first bracket and said connector member has a pair of opposed spaced apart guide portions thereon, and the other has a pair of elongate guideways thereon which receive and support said guide portions to permit translational movement of said connector member relative to said first bracket along a path defined by said guideways.

20. The mechanism of claim 19, further comprising a layer of material of reduced frictional characteristic interposed between the inter-engaging elements of said first bracket and said connector member to provide a selected sliding interconnection therebetween.

21. The mechanism of claim 18, further comprising a friction element coupled to one of said first bracket and connector member and biasing means yieldably urging said friction element into contact with the other of said first bracket and connector member to provide a selected frictional interconnection therebetween to retain said headrest support bracket and connector member in selected position when no operator force is being applied thereto.

22. A mechanism for supporting and permitting selected adjustment of the position of a headrest relative to a back of a chair, the mechanism comprising a body, a first bracket to which a headrest may be connected, said first bracket being pivotally connected at a first pivot adjacent one end of said body, a second bracket for connecting to a chair back, said second bracket being pivotally connected at a second pivot adjacent an end of said body opposite said one end, a set of plate members pivotally connected adjacent a first set of their ends to said first bracket at a third pivot in a region spaced from said first pivot and pivotally connected adjacent a second set of their ends to said second bracket at a fourth pivot in a region spaced from said second pivot, a clamping mechanism operable to clamp the plate members into locking frictional contact to hold them against movement relative to each other to hold said first and second brackets in selected angular positions relative to the housing, and a release mechanism manually operable to release said clamping mechanism to permit longitudinal movement of said plate members relative to each other and pivotal movement of said first and second brackets relative to said body, wherein the first bracket is adapted to allow translation of the headrest relative to the first bracket.

* * * * *